United States Patent [19]

Kato

[11] 4,075,988

[45] Feb. 28, 1978

[54] APPARATUS FOR CONTROLLING SUPPLY OF FUEL TO INTERNAL COMBUSTION ENGINE

[75] Inventor: Takashi Kato, Susono, Japan

[73] Assignee: Toyota Jidosha Kogyo Kabushiki Kaisha, Japan

[21] Appl. No.: 740,221

[22] Filed: Nov. 9, 1976

[30] Foreign Application Priority Data

Jul. 22, 1976 Japan ..... 51-86499

[51] Int. Cl.[2] ..... F02O 11/10; F02J 9/00; F02J 33/02

[52] U.S. Cl. ..... 123/97 B; 123/102; 123/32 EL

[58] Field of Search ..... 123/97 B, 102, 32 EL, 123/119 UC, 119 EC

[56] References Cited

U.S. PATENT DOCUMENTS

| | | | |
|---|---|---|---|
| 3,570,460 | 3/1971 | Rabus | 123/97 B |
| 3,581,839 | 6/1971 | Carp | 123/97 B |
| 3,596,640 | 8/1971 | Bloomfield | 123/32 EL |
| 3,702,603 | 11/1972 | Baxendale et al. | 123/97 B |
| 3,720,191 | 3/1973 | Rachel | 123/32 EL |
| 3,735,742 | 5/1973 | Auno | 123/32 EL |
| 3,756,208 | 9/1973 | Toda et al. | 123/97 B |
| 3,809,028 | 5/1974 | Luchaco | 123/32 EL |
| 3,841,281 | 10/1974 | Mick | 123/97 B |
| 3,866,584 | 2/1975 | Bigalke | 123/32 EL |
| 3,983,851 | 10/1976 | Hoshi | 123/97 B |

*Primary Examiner*—Wendell E. Burns
*Attorney, Agent, or Firm*—Stevens, Davis, Miller & Mosher

[57] ABSTRACT

Herein disclosed is an apparatus for controlling the supply of fuel to an internal combustion engine provided with a carburetor which includes fuel passageway means adapted for communicating a fuel source with an intake system at a position located downstream of a throttle valve.

The apparatus includes means for substantially stopping the supply of fuel through the fuel passageway when the engine is operating under a slow deceleration rate of the rotation speed while the throttle valve is fully closed. In addition, the fuel consumption efficiency can be enhanced, and afterburning can be prevented.

3 Claims, 4 Drawing Figures

APPARATUS FOR CONTROLLING SUPPLY OF FUEL TO INTERNAL COMBUSTION ENGINE

FIELD OF THE INVENTION

The present invention relates to an apparatus for controlling the supply of fuel to an internal combustion engine, which apparatus is adapted for substantially, stopping the supply of fuel to the engine when the engine is operating under a slow deceleration rate of the engine rotational speed.

BACKGROUND OF THE INVENTION

In an internal combustion engine of the carburetor type, misfire easily takes place when the engine operates under a slow deceleration rate while the throttle valve is fully closed, for example, when a vehicle is operating on a long downhill slope, because the amount of air introduced into the intake system is reduced due to the fully closed throttle valve while an excess amount of fuel is sucked into the intake system due to the high vacuum level in the intake system, so that an unburnt air-fuel mixture is exhausted into the exhaust system. This not only causes an inefficiency to occur in the fuel consumption of the engine, but also a so-called "afterburning" when the engine is provided with a catalytic converter in the exhaust system, because the unburnt air-fuel mixture is explosively burnt in the exhaust system due to the high temperature of the catalytic converter. When afterburning is taking place, the catalytic material packed in the catalytic converter becomes overheated and inactivated.

To overcome this difficulty, an apparatus has already been proposed for stopping the supply of fuel to the internal combustion engine during the operation of the engine deceleration. In this known apparatus, the deceleration operation is detected by the fully closed position of the throttle valve and by an engine rotational speed higher than the predetermined speed. In this case, the predetermined rotational speed should be determined so that it is a high enough rotational speed, for example 2500 r.p.m, with respect to the idle rotational speed, for example 750 r.p.m. This is because, if the predetermined rotational speed is near the idler rotational speed, the engine can easily be stopped when the engine rotational speed is being quickly decelerated due to the delay in the starting of the resupplying operation of fuel to the engine. Such quick deceleration of the engine rotational speed is realized, for example, when the clutch is disengaged; or when the engine rotational speed is abruptly increased under no load while the vehicle is being stopped.

However, the rotational speed at which the supply of fuel is stopped is high, the fuel stopping operation is not carried out when the vehicle is running in the city in which the rotational speed of the engine is normally low. Thus, the fuel consumption efficiency is reduced.

SUMMARY OF THE INVENTION

An object of the present invention is to provide an apparatus for controlling the supply of fuel to the internal combustion engine, which can overcome the above drawbacks of the prior art.

Another object of the invention is to provide such an apparatus which can substantially stop the supply of fuel to the engine when the engine rotational speed is slowly being decelerated.

According to the invention, there is provided an apparatus for controlling the supply of fuel to an internal combustion engine provided with a carburetor which includes fuel passageway means adapted for communicating a fuel source with an intake system at a position located downstream of a throttle valve. Said apparatus comprises: valve means capable of opening and closing said fuel passageway means; means for sensing the engine during a running condition wherein the deceleration rate of the engine rotational speed is lower than a predetermined rate, while said throttle valve is substantially being closed; and means connected to said sensing means for operating said valve means so as to cause said fuel passageway means to be closed while the engine is in said running condition in order in substantially, stop the supply of fuel from the carburetor to the intake system. Therefore, an unnecessary consumption of fuel during such running condition is prevented, and thus the fuel consumption efficiency is enhanced. Further, since no unburnt air fuel mixture is exhausted during such running condition, afterburning is prevented.

DESCRIPTION OF A PREFERRED EMBODIMENT

Figure 1:
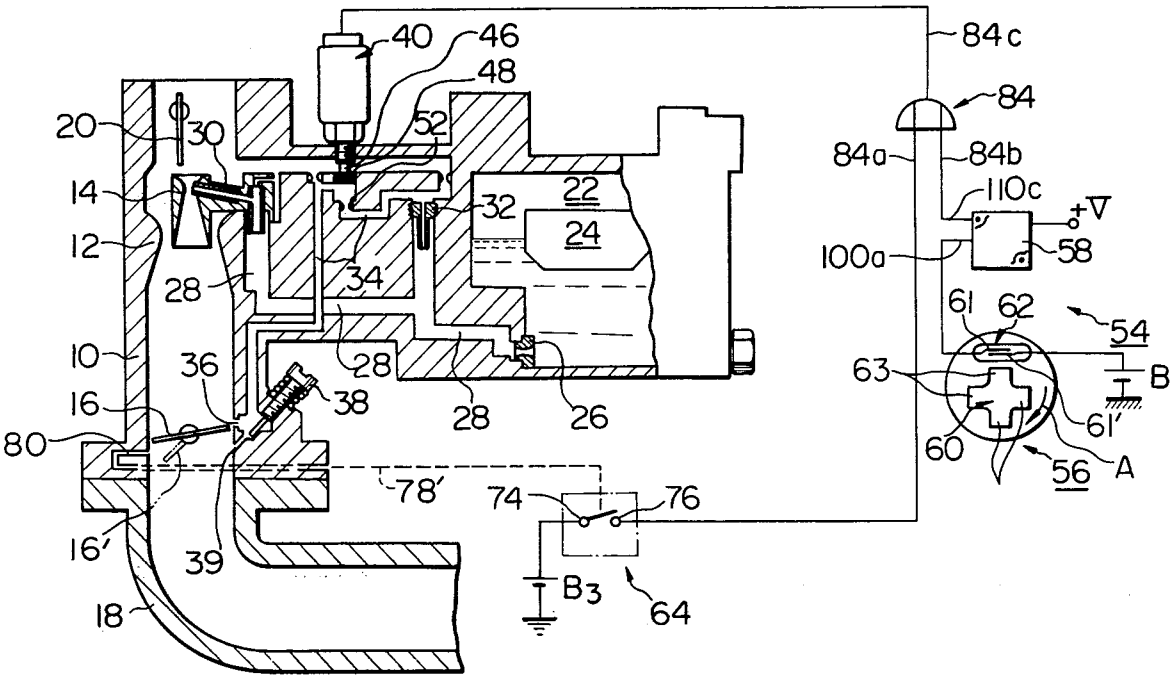
FIG. 1 is a schematic view of the apparatus for controlling a supply of fuel to an internal combustion engine.

Referring to FIG. 1 showing a carburetor portion of an internal combustion engine, numeral 10 designates a carburetor barrel. A large venturi 12 is formed on the inner surface of the burrel 10. A small venturi 14 is arranged slightly above the large venturi 12, and a throttle valve 16 is arranged downstream of the large venturi 12. An intake manifold 18 is connected to the barrel 10 at the bottom end thereof. Numeral 20 designates a choke valve arranged above said the small venturi 14.

A float chamber 22 is formed in a side extension of the burrel 10 to store an amount of fuel therein. A float 24 in the chamber 22 serves to control a predetermined level of the fuel in the float chamber 22. A main jet 26 is provided near the bottom of the float chamber 22, in order to communicate the float chamber 22 with a high speed fuel passageway 28. One end of the passageway 28 remote from the main jet 26 is opened to the small venturi 14 through a main nozzle 30, in order to spray the fuel into the barrel 10 toward the throttle valve 16.

The main passageway 28 communicates with a low speed fuel passageway 34 through a low speed jet 32. One end of the passageway 34 remote from the low speed jet 32 is opened to the inner surface of the barrel 10 through a low speed port 36 located slightly above the throttle valve 16 which is fully closed as shown in FIG. 1. The end of the low speed passageway 34 is also opened to the inner surface of the barrel 10 through an idle port arranged downstream of the throttle valve 16. A screw 38 operates to adjust the amount of fuel supplied from the idle port 39 into the barrel 10, allowing a stabilized idle operation to be effected.

Figure 2:
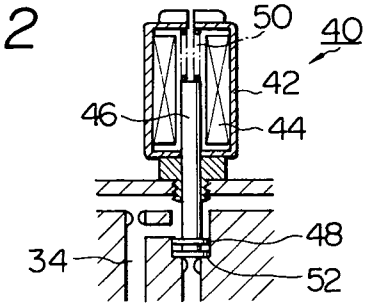
FIG. 2 is an enlarged cross-sectional view of an electromagnetic value shown in FIG. 1.

Numeral 40 designates an electromagnetic valve adapted for stopping a supply of fuel through the passageway 34 when the engine is in a slow deceleration operation in which the deceleration rate of the engine rotational speed is lower than a predetermined rate. The electromagnetic valve 40, as shown in FIG. 2, comprises a stationary case 42, a solenoid 44 arranged in the stationary case 42, a rod 46, the upper end of which is inserted into the solenoid 44, a valve member 48 secured to the lower end of the rod 46, and a coil spring 50 urging the rod 46 so that the valve member 48 is moved away from the stationary case 42. In the OFF position shown in FIG. 2 in which the solenoid 44 is not energized, the valve member 48 is seated on a valve seat 52 formed in a low speed passageway 34 under a force cased by the coil spring 50 to close the passageway 34, so that the supply of fuel to the idle port 39 (shown in FIG. 1) through the passageway 34 is stopped. On the other hand, in the ON position shown in FIG. 1 in which the solenoid 44 is energized, the valve member 48 is detached from the valve seat 52 against the spring 50 (shown in FIG. 2) to open the passageway 34 under the electromagnetic force existing between the rod 46 and the energized solenoid 44, (shown in FIG. 2), so that the fuel from the float chamber 22 is allowed to be directed toward the idle port 39.

It should be noted that the valve 40 is normally in the ON position in which the valve member 48 is detached from the valve seat 52 as shown in FIG. 1, so that the fuel from the float chamber 22 can be introduced into the idle port 39. However, when the engine is operating under a show deceleration rate, the valve 40 is switched to the OFF position in which the valve member 48 is seated on the valve seat 52 as shown in FIG. 2, so that the introduction of fuel to the idle port 39 (shown in FIG. 1) is stopped. This switching operation of the valve 40 is effected by a controlling device, which will be fully described hereinafter.

Numeral 54 in FIG. 1 generally designates a sensing unit adapted for providing an electrical signal when the engine is operating under a decelerating condition in which the deceleration rate of the engine rotational speed is smaller than the predetermined rate. The sensing unit 54 includes a rotation pulse generator unit 56 and a deceleration rate detecting unit 58. The rotation pulse generator unit 56 includes a rotary member 60 made of a permanent magnetic material of a cross-shape in the transverse cross-section. The member 60 is an integral part of a cam shaft of the distributor (not shown) of the engine and therefore is mechanically connected to the crankshaft of the engine. This allows the member 60 to be rotated in one direction, for example, in the direction shown by an arrow A in accordance with the rotation of the engine. The unit 56 further includes a reed switch 62 which is stationarily arranged near the cross-shaped rotary member 60 and which has two reed members 61 and 61' arranged so as to face each other across a small distance. As is clear from the arrangement of the rotation pulse generator unit 56, the reed members 61 and 61' of the switch 62 are touching each other so as to provide an electric pulse current each time one of the four ends 63 of the cross-shaped rotary member 60 faces the reed switch 62 during the rotation of the member 60 in the direction of the arrow A, if a battery B is used. Therefore, a pulsating current, which is transmitted to the deceleration rate detecting unit 58, is provided. The frequency of the current corresponds to the number of rotations of the rotary member 60, in other words, the number of rotations of the engine.

Figure 3:
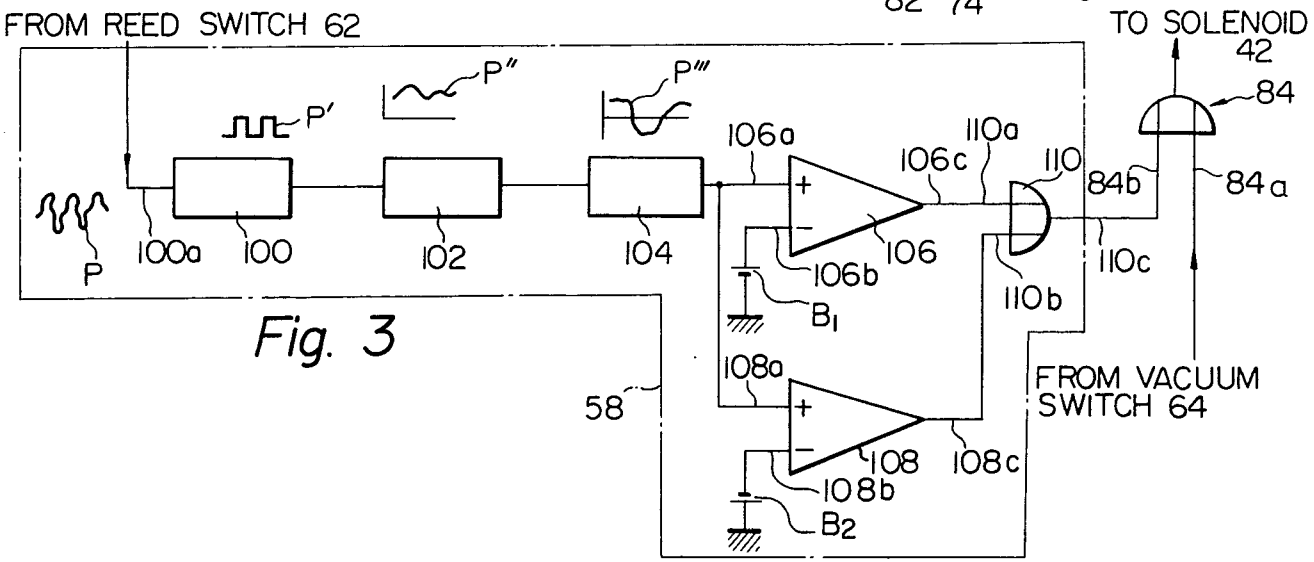
FIG. 3 is a diagrammatic flowchart of the deceleration rate detecting unit shown in FIG. 1.

The deceleration rate detecting unit 58 has, as shown in FIG. 3, a monostable circuit 100 connected to the reed switch 62 to modify the pulsating current P from the switch 62 into a pulsating current as shown by P'. Connected to the monostable circuit 100 is a frequency-voltage converter 102 for converting the frequency signal of the pulsating current P' (frequency of which current P' corresponds to the rotational speed of the engine) into a voltage current P'' (voltage level of which current P'' corresponds to the rotational speed of the engine). A differential circuit 104 is connected to the frequency-voltage converter 102 for differentiating between the voltage signal P'' corresponding to the engine rotational speed and said converter 102, in order to obtain a voltage signal P''' which corresponds to the rate of change of the engine rotational speed. It should be noted that the engine deceleration condition is indicated by a negative voltage signal from the differential circuit 104, and the deceleration rate of the engine corresponds to the level of the negative voltage level. That is to say, the higher the negative level, the greater the deceleration rate. The deceleration rate detecting unit 58 further includes a set of comparators 106 and 108. The comparator 106 is connected to the differential circuit 104 at an input **106*a* of the comparator 106. Another input 106*b* of the comparator 106 is connected to a battery $B_1$ for producing a voltage level corresponding to an engine condition in which the acceleration rate of the engine rotational speed is zero. Therefore, the comparator 106 provides a pulse signal at the output 106*c* thereof when the engine operates under acceleration in which the voltage level at the input 106*a* is positive, whereas comparator 106 does not provide a pulse at the output 106*c* when the engine operates under deceleration in which the voltage level at the input 106*a* is negative. The comparator 108 is connected to the differential circuit 104 at one input 108*a*. Another input 108*b* is connected to a battery $B_2$ for producing a negative voltage level corresponding to an engine condition in which the engine operates under a predetermined level of the deceleration rate. Therefore, the comparator 108 provides a pulse signal at the output 108*c* thereof when the negative voltage level at the input 108*a* is higher than the level at the input 108*b*. In other words, the engine operates under an abrupt deceleration condition in which the deceleration rate of the rotational speed is higher than the predetermined deceleration rate. Whereas the comparator 108 provides no pulse at the output 108*c*** when the engine is operating under a slow deceleration condition in which the deceleration rate is lower than the predetermined rate.

The output **106*c* of the comparator 106 and the output 108*c* are connected to the respective inputs 110*a* and 110*b* of an OR gate 110. Therefore, the OR gate 110 provides a pulse signal at the output 110*c*, when at least one pulse is received at the inputs 110*a* and 110*b*, from the comparators 106*a* and 108*c*; in other words, when the engine is not in a slow deceleration operation. Whereas the OR gate 110 provides no pulse signal at said output 110*c* when no pulse is received at the inputs 110*a* and 110*b*; from the comparators 106 and 108**, in other words, when the engine is in a slow deceleration operation.

Figure 4:
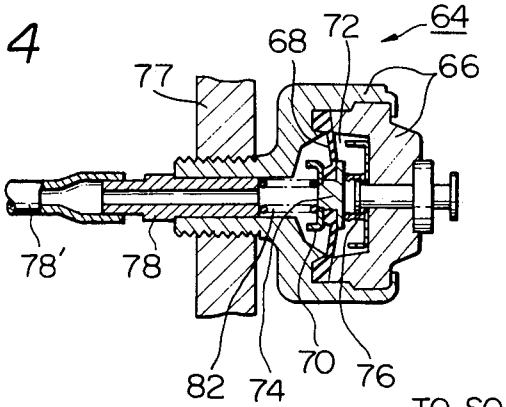
FIG. 4 is an enlarged cross-sectional view of the vacuum switch shown in FIG. 1.

To expect an effective operation of the hereinabove-described apparatus for stopping the supply of fuel when the engine is in the slow deceleration rate operation, it is necessary to provide means for preventing the stopping of the supply of fuel by utilizing the apparatus of the present invention when the engine is operating on an uphill slope. This is because the engine rotational speed is, sometimes, decelerated when the engine is operating on an uphill slope. If the supply of the fuel is cut off while operating on the uphill slope, the engine will immediately stop functioning. For detecting whether or not the engine is on an uphill slope, the apparatus according to the invention further has a vacuum switch 64 adapted for detecting whether the throttle valve 16 is fully closed or not. This vacuum switch 64 comprises, as shown in FIG. 4, the housings 66 secured to an engine body 77 and a diaphragm 68 arranged across the interior of the housings 66. A chamber 70 is formed on one side of the diaphragm 68 and connected, via a union 78 and a pipe 78', to a port 80 (FIG. 1) formed in the carburetor barrel 10 slightly downstream of the throttle valve 16 which is fully closed, as shown in FIG. 1. In FIG. 4, another chamber 72 is formed on the other side of the diaphragm 68 and opened to the atmosphere. A movable contact 74 is secured to the diaphragm 68, whereas a stationary contact 76 is secured to an inner wall of the housing 66 in the chamber 72. A spring 82 urges the diaphragm toward the stationary contact 76. The vacuum switch 64 is in the ON condition in which the movable contact 74 comes in contact with the stationary contact 76 when the chamber 70 is opened to the atmosphere, because the spring 82 urges the diaphragm 68 toward the stationary contact 76, as shown in FIG. 4. The chamber 70 is opened to the atmosphere when the throttle valve 16 (FIG. 1) is opened, as shown by the phantom line 16' in FIG. 1, so that the valve is located downstream of the port 80 (FIG. 1). Said vacuum switch 64 is switched to the OFF position in which position the movable contact 74 is detached from the stationary contact 76, because a vacuum signal is transmitted to the chamber 70 from the port 80 (FIG. 1), due to the fact that the diaphragm 68 is moved remote from the stationary contact 76 against the spring 82. The negative pressure signal is transmitted to the chamber 70, when the throttle valve 16 (FIG. 1) is fully closed as shown in FIG. 1, so that the valve 16 is located upstream from the port 80 (FIG. 1).

As shown in FIG. 1, the movable contact 74 of the vacuum switch 64 is connected to a battery $B_3$, whereas the stationary contact 76 is connected to an OR gate 84 at one input **84*a* thereof. Connected to another input 84*b* of the OR gate 84 is the output 110*c* (see FIG. 3) of the deceleration rate detecting unit 58 (FIG. 1). The OR gate 84 provides a pulse signal at an output 84*c* thereof, when at least one pulse signal is received at the input 84*b* from the deceleration rate detecting unit 58, or at the input 84*a* from the vacuum switch 64 due to the fact that the engine is not in the slow deceleration rate operation. Thereby, the pulse signal at the output 84*c* is transmitted to the solenoid 44 (FIG. 2) of the electromagnetic valve 40 causing the valve member 48 to be opened, as shown in FIG. 1. The OR gate 84 does not provide a pulse at the output 84*c* thereof when no pulse is received at said inputs 84*a* and 84*b* due to the fact that the engine is in the slow deceleration rate operation. Thereby, the solenoid 44 is deenergized causing the valve member 48 to rest on said valve seat 52 as shown in FIG. 2 for stopping the supply of fuel through the passageway 34**.

Fuel supply Stopping Operation

In the use of the above-mentioned apparatus, when the vehicle is operating on a long downhill slope wherein the engine is operating under the slow deceleration condition, which deceleration rate of the engine rotation speed is smaller than a predetermined rate while the throttle valve is fully closed, the deceleration rate detecting unit 58 provides no pulse at the output **110*c* of the OR gate 110, because no pulse is likewise received at the input 110*a* of the OR gate 110 and because no pulse is received at the input 110*b* of the OR gate 110. In this case, since the throttle valve 16 is fully closed, as shown in FIG. 1, the switch 64 is caused to be switched to the OFF position in which position the movable contact 74 is detached from the stationary contact 76 are as shown in FIG. 1. Therefore, no pulse is received at the input 84*a* of the OR gate 84. Because no pulse is received at the inputs 84*a* and 84*b*, the OR gate 84 does not provide a pulse at the output 84*c*, thus not causing the solenoid 44 (FIG. 2) of the electromagnetic valve 40 to be energized. As a result of this, as shown in FIG. 2, the valve member 48 is rested on the valve seat 52 by the force of the spring 50 in order to close the fuel passageway 34, whereby no fuel is sucked from the idle port 39** into the intake system by the vacuum pressure formed in the intake system. Thus, an unnecessary consumption of fuel is prevented when the vehicle is operating on a long downhill slope, and therefore the fuel consumption efficiency of the engine is enhanced. It should be noted that, according to the invention, the so-called afterburning, which occurs when the engine is operating on a downhill slope, is also prevented because no fuel is supplied to the intake system and no unburnt fuel is exhausted into the exhaust system.

Normal Operation

During when the engine is operating on an uphill slope wherein the engine rotational speed is slowly being decelerated, no pulse is transmitted from the deceleration rate detecting unit 58 to the input **84*b* of the OR gate 84, as is previously described. In this uphill slope operation, however, a pulse signal is received at the other input 84*a* of the OR gate 84 in order to provide a pulse signal at the output 84*c* of the OR gate 84, for energizing the solenoid 44 of the electromagnetic valve 40. This is because in this uphill slope operation the throttle valve 16 is opened as shown by the phantom line 16' in FIG. 1, so that said valve is located downstream of the port 80. Consequently, the solenoid 44 moves the valve member 48 due to the electromagnetic force formed between the energized solenoid 44 and the rod 46, whereby the valve member 48 is detached from the valve seat 52 as shown in FIG. 1. Thus, the fuel passageway 34 is opened for preventing a fuel-stopping operation according to the present invention so that fuel could be introduced into the intake system through the idle port 39** for effecting a normal engine operation.

When the engine is operating under a condition other than the slow deceleration rate operation, the deceleration rate detecting unit 58 provides a pulse at the output **110*c* of the OR gate 84, for energizing the solenoid 44 of the electromagnetic valve 40. Thus, the fuel passageway 34 is opened for preventing a fuel-supply stopping operation, wherein the fuel could be introduced into the intake system through the idle port 39** for effecting a normal engine operation.

The above description discloses that the supply of fuel is stopped by the electromagnetic valve 40 during the slow deceleration operation. However, it is also possible to allow a slight amount of fuel to pass through the valve 40 between the valve member 48 and the valve seat 52, during when the valve 40 is operating. In this case, a slight amount of unburnt air-fuel mixture is unavoidably supplied into the engine during the low deceleration process. However, this amount is not sufficient enough to cause an afterburning.

While this invention is disclosed by describing only one embodiment with reference to the accompanying drawings, however, many modifications can be made by those who are skilled in this art without departing from the spirit and the scope of this invention.

What is claimed is:

1. An apparatus for controlling the supply of fuel to an internal combustion engine provided with a carburetor which includes fuel passageway means adapted for communicating a fuel source with an intake system at a position located downstream of a throttle valve, said apparatus comprising:

valve means capable of opening and substantially closing said fuel passageway means;

means for sensing the engine during a running condition wherein the deceleration rate of the engine rotational speed is lower than a predetermined rate, while said throttle valve is substantially being closed, and;

means connected to said sensing means for operating said valve means so as to cause said fuel passageway means to be substantially closed while the engine is in said running condition in order to substantially stop the supply of fuel from said carburetor to said intake system.

2. An apparatus for controlling the supply of fuel according to claim 1, wherein said valve means comprises an electromagnetic valve device having a valve member which is normally in a position wherein the fuel passageway means is opened, and having a solenoid which is energized by said valve operating means to cause said valve member to be moved into another position wherein said fuel passageway means are closed when the engine is in said running condition.

3. An apparatus for controlling the supply of fuel according to claim 2, wherein said means for sensing the engine running condition comprises: a first sensing device adapted for providing a first electric pulse when the deceleration rate of the rotational speed of the engine is lower than a predetermined rate; a second sensing device adapted for providing a second electric pulse when said throttle valve is substantially fully closed; and an operating circuit adapted to operate said electromagnetic valve device to cause said fuel passageway means to be closed by said valve member when said first and second electric pulses are received by said solenoid.

* * * * *